US009593649B2

(12) United States Patent
Hasegawa et al.

(10) Patent No.: US 9,593,649 B2
(45) Date of Patent: Mar. 14, 2017

(54) ENGINE

(71) Applicant: IHI Shibaura Machinery Corporation, Matsumoto-shi (JP)

(72) Inventors: Naohiro Hasegawa, Matsumoto (JP); Takeshi Sakai, Matsumoto (JP); Seigo Tanimoto, Matsumoto (JP); Yuichi Kawaai, Matsumoto (JP)

(73) Assignee: IHI Shibaura Machinery Corporation, Nagano (JP)

( * ) Notice: Subject to any disclaimer, the term of this patent is extended or adjusted under 35 U.S.C. 154(b) by 63 days.

(21) Appl. No.: 14/416,542

(22) PCT Filed: Jul. 22, 2013

(86) PCT No.: PCT/JP2013/069775

§ 371 (c)(1),
(2) Date: Jan. 22, 2015

(87) PCT Pub. No.: WO2014/017428

PCT Pub. Date: Jan. 30, 2014

(65) Prior Publication Data

US 2015/0176546 A1 Jun. 25, 2015

(30) Foreign Application Priority Data

Jul. 24, 2012 (JP) ..... 2012-164217

(51) Int. Cl.
*F02M 35/104* (2006.01)
*F02M 25/07* (2006.01)
*F02M 35/10* (2006.01)

(52) U.S. Cl.
CPC ..... *F02M 35/104* (2013.01); *F02M 26/21* (2016.02); *F02M 35/10222* (2013.01)

(58) Field of Classification Search
CPC .. F02M 25/07; F02M 35/10; F02M 35/10222; F02M 35/104; F02D 9/02; Y02T 10/121
USPC ..... 123/184.21, 184.24–184.27, 184.42, 123/184.43, 184.48, 184.49, 568.11, 123/568.14, 568.17
See application file for complete search history.

(56) References Cited

FOREIGN PATENT DOCUMENTS

JP 58-158160 U 10/1983
JP 4-123359 U 11/1992
(Continued)

OTHER PUBLICATIONS jp 2001-123901 English Translation Version.*
Japanese International Search Report based on PCT/JP2013/069775 mailed Aug. 13, 2013.

*Primary Examiner* — John Kwon
*Assistant Examiner* — Johnny H Hoang
(74) *Attorney, Agent, or Firm* — Sterne, Kessler, Goldstein & Fox P.L.L.C.

(57) ABSTRACT

An air intake route leads air drawn in from outside into a diesel engine. The air intake route is provided with an air intake manifold and an EGR device is provided which supplies some of the exhaust to the air intake route. An introduction path for introducing exhaust supplied from the EGR device is provided inside of the air intake manifold, and an exhaust port of the introduction path is arranged downstream from and near the intake entrance in the air intake manifold. By this means, exhaust gas performance can be improved without increasing the engine size.

4 Claims, 7 Drawing Sheets

(56) References Cited

FOREIGN PATENT DOCUMENTS

| | | | |
|---|---|---|---|
| JP | 2000-008967 | A | 1/2000 |
| JP | 2000-045880 | A | 2/2000 |
| JP | 2003-269260 | A | 9/2003 |
| JP | 2011-012573 | A | 1/2011 |
| JP | 2012-097566 | A | 5/2012 |

* cited by examiner (2A) intake stroke (2B) compression stroke (2C) expansion stroke (2D) exhaust stroke

ENGINE

BACKGROUND OF THE INVENTION

Technical Field

The present invention relates to an art of an engine having an EGR device.

Background Art

Conventionally, an engine in which fuel is injected to a combustion chamber and burnt in the combustion chamber is known. The engine has an intake path which guides air sucked from the outside (intake air) to an inside of the combustion chamber of the engine, and the intake path has an intake manifold for distributing the intake air (for example, see the Patent Literature 1).

An engine which has an EGR device supplying a part of exhaust gas to an intake path is also known. By circulating the part of the exhaust gas to the intake path by the EGR device, nitrogen oxide in the exhaust gas can be reduced so as to improve fuel efficiency at the time of increase of load.

PRIOR ART REFERENCE PATENT LITERATURE

Patent Literature 1: the Japanese Patent Laid Open Gazette 2011-12573

BRIEF SUMMARY OF THE INVENTION

Problems to Be Solved by the Invention

In the above engine, for mixing the intake air and the supplied exhaust gas largely, it is necessary to make a distance from a mixing position to an intake port long. Then, the exhaust gas (EGR gas) supplied from the EGR device is made to join the intake air in an intake pipe provided outside the intake manifold.

However, when the length of the intake pipe provided in the outside is extended, the whole engine is enlarged, whereby the length of the intake pipe is limited. Then, the distance from the mixing position to the intake port cannot be made longer for mixing the intake air and the exhaust gas more largely. Accordingly, the EGR gas and the intake air may not be mixed enough and then distributed to the intake ports, thereby causing unstable combustion.

Since the mixing at the downstream side is performed more largely than the mixing at the upstream side, a mixing rate of the EGR gas and the intake air in the intake port at the upstream side is different from that in the intake port at the downstream side, whereby the exhaust gas performance of the whole engine is reduced.

In consideration of the above problems, the present invention provides an engine whose exhaust gas performance is improved without enlarging the whole engine.

Means for Solving the Problems

In an engine according to a first mode of the present invention, an intake path which guides air sucked from the outside into the engine is provided, the intake path has the intake manifold, an EGR device supplying a part of exhaust gas to the intake path is provided, an introduction path for introducing the exhaust gas supplied from the EGR device is provided inside the intake manifold, and an exhaust port of the introduction path is arranged near a downstream side of an intake inlet of the intake manifold.

An engine according to a second mode of the present invention is the engine according to the first mode in which the exhaust port is provided so as to make a flow direction of the exhaust gas discharged from the exhaust port perpendicular to a flow direction of intake air.

An engine according to a third mode of the present invention is the engine according to the second mode in which a valve is provided in the intake inlet of the intake manifold, and a valve shaft of the valve is arranged perpendicularly to the flow direction of the exhaust gas discharged from the exhaust port.

An engine according to a fourth mode of the present invention is the engine according to the third mode in which the intake manifold has a plurality of intake ports, the intake ports are arranged in a line and the intake inlet is arranged above a center of the line.

Effect of the Invention

The present invention configured as the above brings the following effects.

According to the first mode, the mixing efficiency of the exhaust gas (EGR gas) and the intake air can be improved without enlarging the whole engine, whereby exhaust gas performance can be improved.

According to the second mode, the exhaust gas (EGR gas) surely contacts the flow of the intake air, whereby the mixing efficiency of the EGR gas and the intake air can be improved further.

According to the third mode, the exhaust gas (EGR gas) and the intake air are mixed for a short period by the turbulence generated by the passage of the gas through the valve, whereby the mixing efficiency can be improved further.

According to the fourth mode, the mixing rate of mixture intake gas supplied to each of the intake ports is substantially uniform, whereby the exhaust gas performance of the whole engine can be improved.

DETAILED DESCRIPTION OF THE INVENTION

Next, an explanation will be given on a mode for carrying out the invention.

Figure 1:
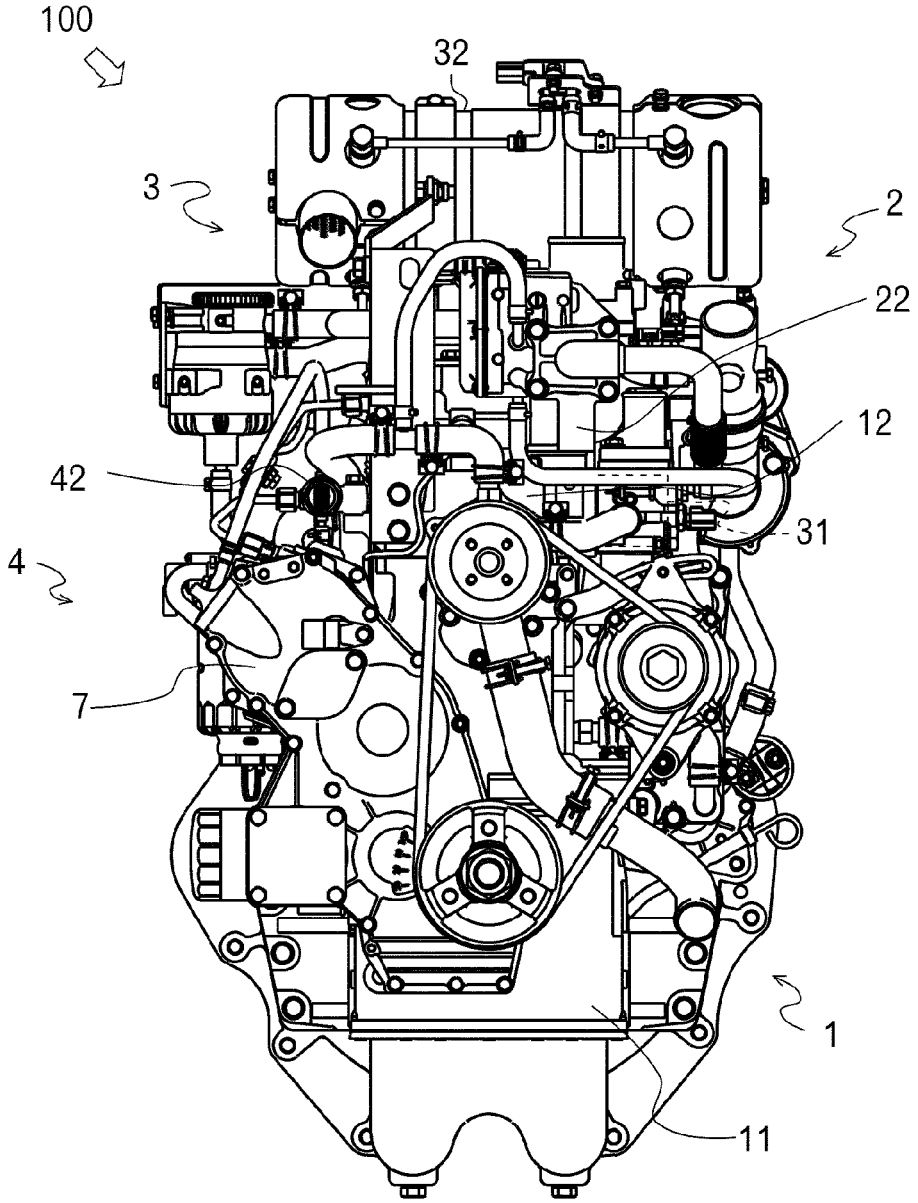
FIG. 1 is a front view of an engine.
Figure 4:
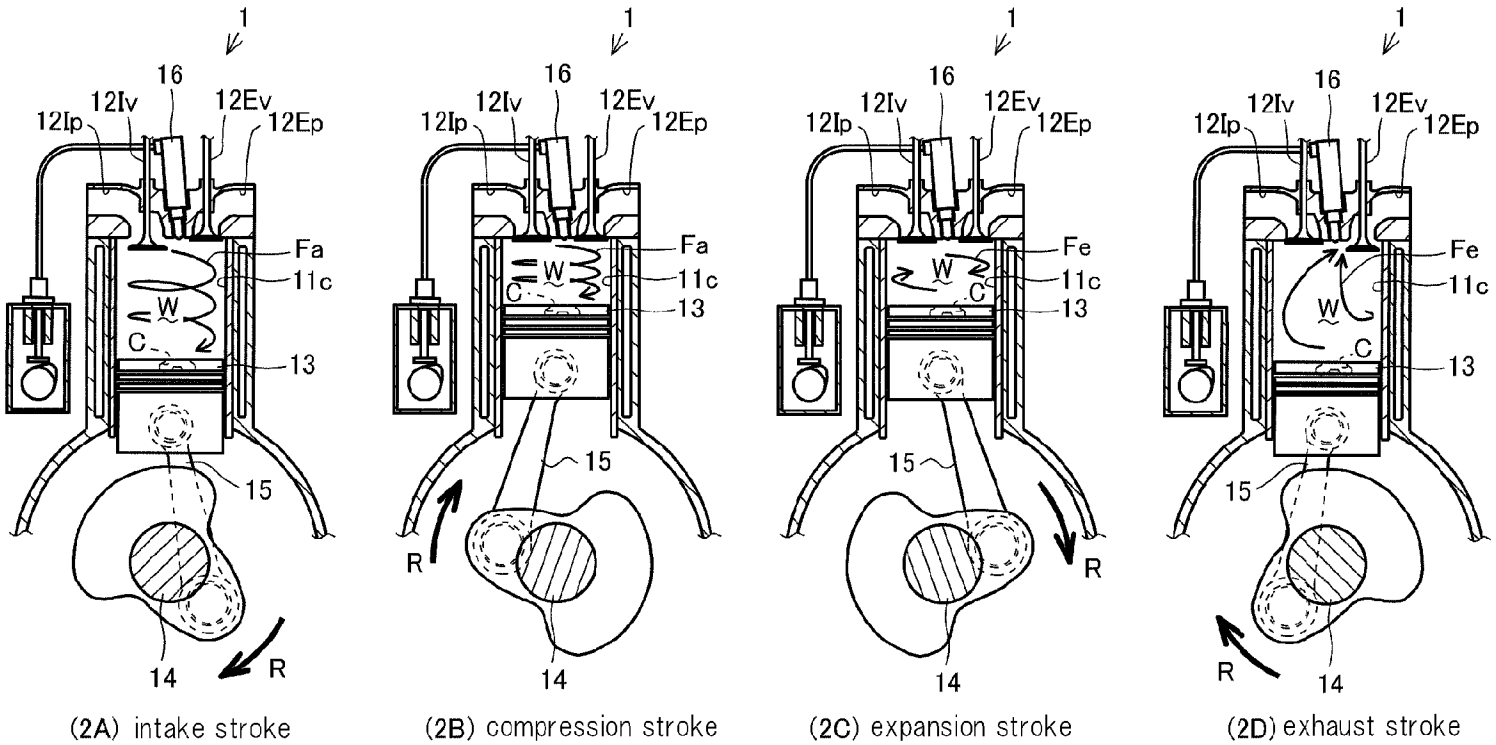
FIG. 4 is a schematic drawing of an operation mode of the engine.

Firstly, an explanation will be given on a diesel engine 100 in brief. A foreground side of FIG. 1 is defined as a front side. An arrow Fa in FIG. 4 shows a flow direction of sucked air, and an arrow Fe in FIG. 4 shows a flow direction of exhaust gas. An arrow R in FIG. 4 shows a rotation direction of a crankshaft 14.

Figure 2:
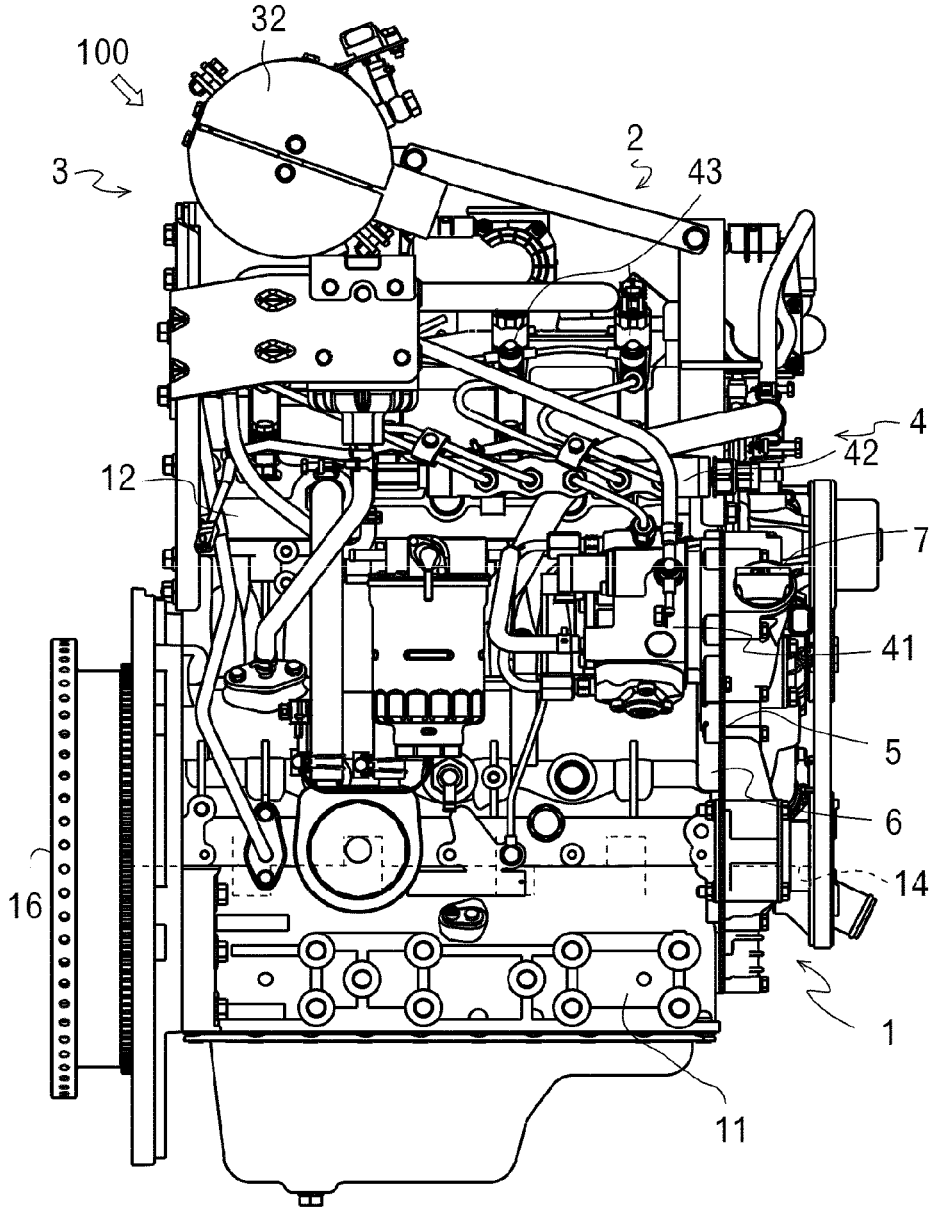
FIG. 2 is a right side view of the engine.
Figure 3:
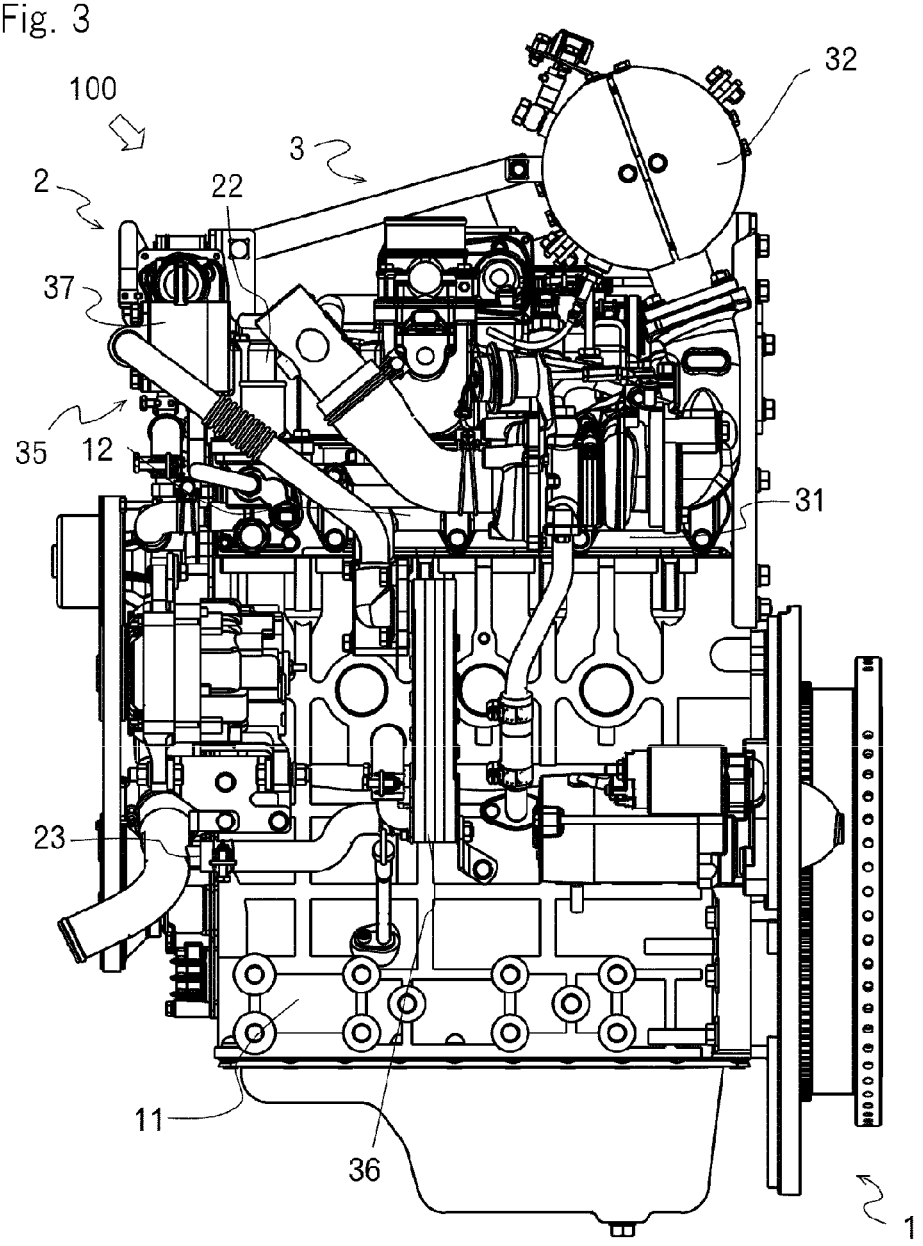
FIG. 3 is a left side view of the engine.

As shown in FIGS. 1 to 3, the diesel engine 100 mainly includes an engine main part 1, an intake path 2, an exhaust path 3 and a common rail system 4.

The engine main part 1 generates rotation power by using expansion energy of combustion of fuel. The engine main part 1 mainly includes a cylinder block 11, a cylinder head 12, a piston 13 and the crankshaft 14.

In the engine main part 1, as shown in FIGS. 1 and 4, a cylinder 11*c* provided in the cylinder block 11, the piston 13 provided slidably inside the cylinder 11*c*, and the cylinder head 12 arranged oppositely to the piston 13 constitute an operation chamber W. Namely, the operation chamber W means an inner space of the cylinder 11*c* whose capacity is changed by sliding movement of the piston 13. The piston 13 is connected via a connecting rod 15 to a pin part of the crankshaft 14 so that the crankshaft 14 is rotated by the slide of the piston 13. A concrete operation mode of the engine main part 1 is discussed later.

The intake path 2 guides air sucked from the outside into the cylinder 11*c*. Namely, the intake path 2 guides the air sucked from the outside into the operation chamber W. The intake path 2 mainly includes an air cleaner (not shown) and an intake manifold 22 along a flow direction of the air.

The air cleaner filters the sucked air with a filter paper, sponge or the like. The air cleaner filters the air so as to prevent foreign matters such as dust from entering the operation chamber W.

The intake manifold 22 distributes the air filtered by the air cleaner (not shown) to the operation chambers W. Since the diesel engine 100 is a multiple cylinder engine in which the plurality of the operation chambers W are provided, the intake manifold 22 is provided so as to cover an inlet port of an intake port 12Ip provided in each of the operation chambers W. The intake ports 12Ip are arranged in a line in parallel to the longitudinal direction and each distance between the adjacent two intake ports 12Ip is fixed. In the diesel engine 100, since the inlet port of the intake port 12Ip is provided in an upper surface of the cylinder head 12, the intake manifold 22 is attached to the upper surface of the cylinder head 12.

An intake inlet 22*a* is provided in a lateral center part of the intake manifold 22. The intake inlet 22*a* is shaped cylindrically and communicates an upper part of the center of the intake manifold 22 with an inside of the intake manifold 22. A downstream side of the intake inlet 22*a* is arranged in a lateral center part of the inside of the intake manifold 22. According to the configuration, a mixture of intake air and exhaust gas entering via the intake inlet 22*a* at the lateral center part flows to each of the intake ports 12Ip equally as shown by a dashed arrow in FIG. 7, whereby unevenness of the intake can be prevented.

In the intake inlet 22*a*, a valve 27 for controlling an intake amount is provided. In this embodiment, the valve 27 includes a throttle valve which controls a flow amount by changing a sectional area of a flow path. In this embodiment, the valve 27 includes a butterfly type throttle valve which is opened and closed by rotating a disk having substantially the same diameter as the sectional area of the flow path of the intake inlet 22*a* with a valve shaft 27*a* perpendicular to the flow path.

The exhaust path 3 guides exhaust gas discharged from an inside of the cylinder 11*c* to an exhaust port. Namely, the exhaust path 3 guides the exhaust gas discharged from the operation chambers W to the exhaust port. The exhaust path 3 mainly includes an exhaust manifold 31 and an exhaust purification device 32 along a flow direction of the exhaust gas.

The exhaust manifold 31 gathers exhaust gas discharged respectively from the operation chambers W. Since the diesel engine 100 is the multiple cylinder engine in which the plurality of the operation chambers W are provided, the exhaust manifold 31 is communicated with an outlet hole of an exhaust port 12Ep provided in each of the operation chambers W. In the diesel engine 100, since an outlet hole of the exhaust port 12Ep is provided in a side surface of the cylinder head 12, the exhaust manifold 31 is attached to the side surface of the cylinder head 12.

The exhaust purification device 32 removes environmental load substances contained in the exhaust gas. A diesel oxidation catalyst (hereinafter, referred to as "DOC") is provided in the exhaust purification device 32. The DOC oxidizes and detoxifies CO (carbon monoxide) and HC (hydrocarbon), and oxidizes and removes SOFs (soluble organic fractions) which are particle matters.

The common rail system 4 is a fuel injection device whose injection pattern can be set freely. The common rail system 4 mainly includes a supply pump 41, a rail 42 and injectors 43.

The supply pump 41 feeds pressingly fuel discharged from a fuel tank to the rail 42. The supply pump 41 is driven by rotation power of the crankshaft 14 transmitted via a plurality of gears. The supply pump 41 has a plunger slid by rotation of a driving shaft, and the fuel pressurized by the plunger is sent to the rail 42.

The rail 42 stores the fuel, which is fed pressingly from the supply pump 41, at high pressure. The rail 42 is a metal pipe shaped substantially cylindrically. The rail 42 has a limiter valve and is designed so as to prevent pressure of the fuel from exceeding a predetermined value. A plurality of pipes are attached to the rail 42 so as to guide the fuel to the injectors 43.

The injectors 43 inject suitably the fuel supplied from the rail 42. Each of the injectors 43 is attached to the corresponding cylinder head 12 so that a tip of the injector 43 having an injection port is projected into the operation chamber W. The injector 43 has an armature driven by a piezo element or a solenoid for example, and can realize various injection patterns by controlling timing and term of the driving.

In the diesel engine 100, for reducing pressure variation of the fuel in the rail 42, fuel pressure-feed timing of the supply pump 41 synchronizes with fuel injection timing of the injector 43.

Next, an explanation will be given on an operation mode of the diesel engine 100 in brief referring to FIG. 4. The diesel engine 100 is a 4-cycle engine in which an intake stroke, a compression stroke, an expansion stroke and an exhaust stroke are completed while the crankshaft 14 is rotated two times.

In the intake stroke, an intake valve 12Iv is opened and the piston 13 is slid downward so as to suck air into the operation chamber W. A camshaft (not shown) pushes up a pushrod and the pushrod pushes a valve arm, whereby the intake valve 12Iv is opened (see FIG. 4). The camshaft is driven by the rotation power of the crankshaft 14 transmitted via a plurality of gears.

In the compression stroke, the intake valve 12Iv is closed and the piston 13 is slid upward so as to compress the air in the operation chamber W. The intake valve 12Iv is closed by biasing force of a spring. The valve arm is pushed by the intake valve 12Iv, and the pushrod is pushed down by the valve arm.

Subsequently, the fuel is injected from the injector 43 to the air whose temperature and pressure are increased by the compression. Then, the fuel is dispersed and evaporated in a combustion chamber C provided in an upper surface of the piston 13, and mixed with the air and burnt. Accordingly, the diesel engine 100 shifts to the expansion stroke in which the piston 13 is slid downward again.

In the expansion stroke, the piston 13 is pushed down with expansion energy generated by combustion of fuel. Flame formed in the combustion chamber C and the operation chamber W expands air so as to push down the piston 13. In the expansion stroke, rotation torque is applied from the piston 13 via the connecting rod 15 to the crankshaft 14. At this time, since kinetic energy is conserved by a flywheel 16 attached to the crankshaft 14, the rotation of the crankshaft 14 is maintained (see FIG. 2). Accordingly, the diesel engine 100 slides the piston 13 upward again and shifts to the exhaust stroke.

In the exhaust stroke, an exhaust valve 12Ev is opened and the piston 13 is slid upward so as to push out the burnt gas in the operation chamber W as the exhaust gas. A camshaft (not shown) pushes up a pushrod and the pushrod pushes a valve arm, whereby the exhaust valve 12Ev is opened (see FIG. 4). The camshaft is driven by the rotation power of the crankshaft 14 transmitted via a plurality of gears.

Accordingly, the diesel engine 100 completes the intake stroke, the compression stroke, the expansion stroke and the exhaust stroke while the crankshaft 14 is rotated two times. By continuing the strokes in all the operation chambers W, the diesel engine 100 can be driven continuously.

Figure 5:
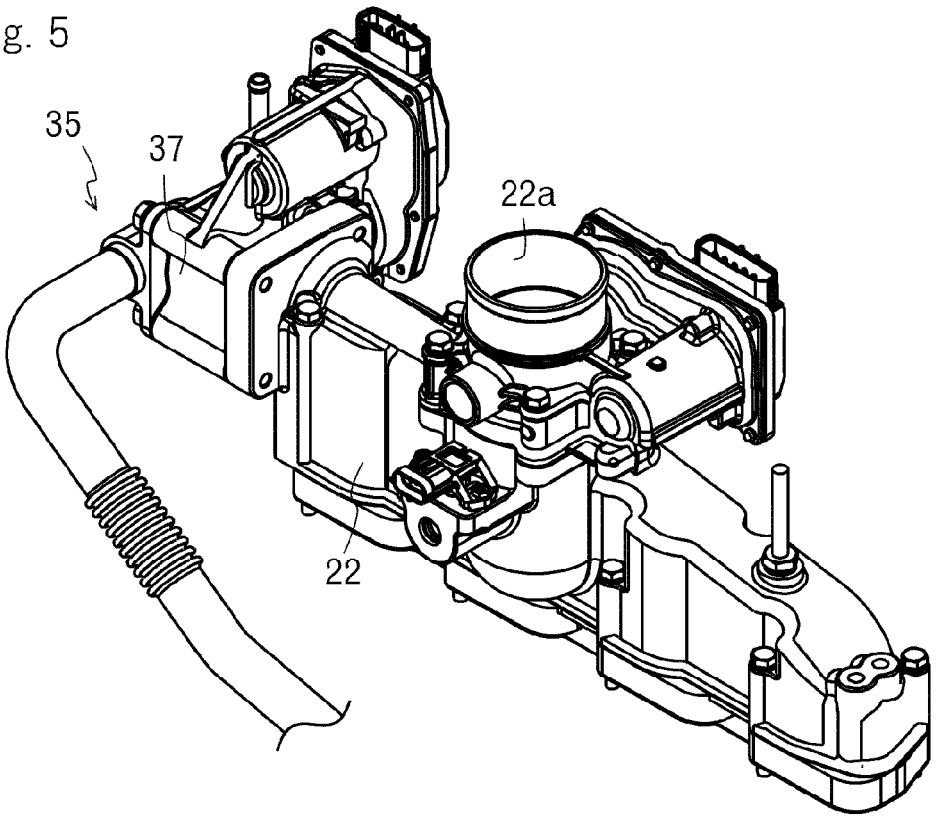
FIG. 5 is a perspective view of an intake manifold.
Figure 6:
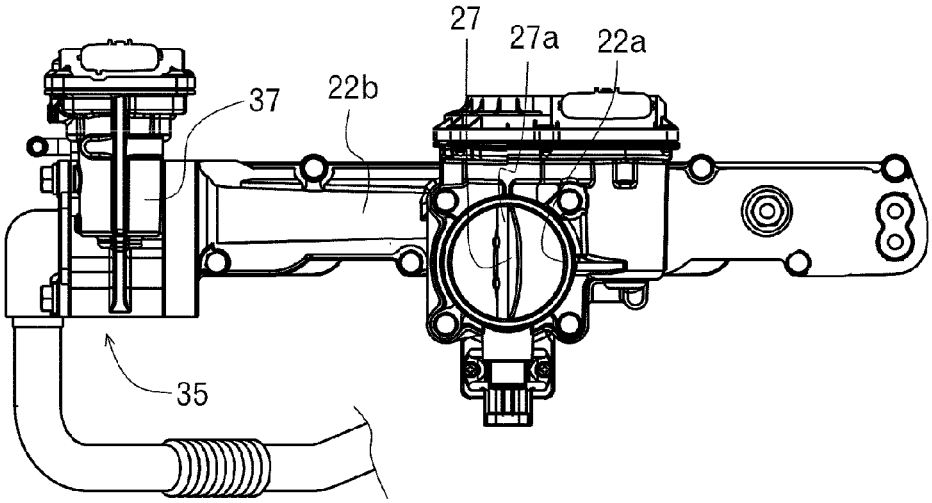
FIG. 6 is a plan view of the intake manifold.

Next, an explanation will be given on the configuration of the intake path 2 according to this embodiment referring to FIGS. 5 to 7.

The intake path 2 has the intake manifold 22 and an EGR device 35 which supplies a part of the exhaust gas to the intake path 2. The EGR device 35 has an EGR cooler 36 and an EGR valve 37 and recirculates a part of the exhaust gas via an EGR branching part 23 provided in a middle part of the exhaust path 3. The exhaust manifold 31, the EGR branching part 23 and the exhaust purification device 32 are arranged in this order toward the downstream side from the exhaust manifold 31 of the exhaust path 3.

The exhaust gas recirculated from the EGR branching part 23 passes through the EGR cooler 36 and the EGR valve 37 and is mixed with the intake air supplied from the intake path 2 in the intake manifold 22, and then sent to the intake ports 12Ip.

The EGR cooler 36 is provided downstream the EGR branching part 23 and arranged in a side surface of the engine main part 1. The exhaust gas flowing into the EGR cooler 36 is cooled with cooling water in the EGR cooler 36. The exhaust gas discharged from the EGR cooler 36 is sent to the EGR valve 37. The EGR valve 37 is provided adjacently to the intake manifold 22, and in this embodiment, contacts a front surface of the intake manifold 22. The EGR valve 37 controls an amount of the exhaust gas recirculated from the exhaust side to the intake side, and the recirculation of the exhaust gas is prevented by closing the EGR valve 37 at the time of low temperature for example.

A surface of a downstream side of the EGR valve 37 is communicated with the intake manifold 22. In more detail, an introduction path 22*b* through which the exhaust gas passes is provided inside the intake manifold 22, and the surface of the downstream side of the EGR valve 37 is communicated with a surface of an upstream side of the introduction path 22*b*. An exhaust port 22*c* is configured in a downstream end of the introduction path 22*b*.

Figure 7:
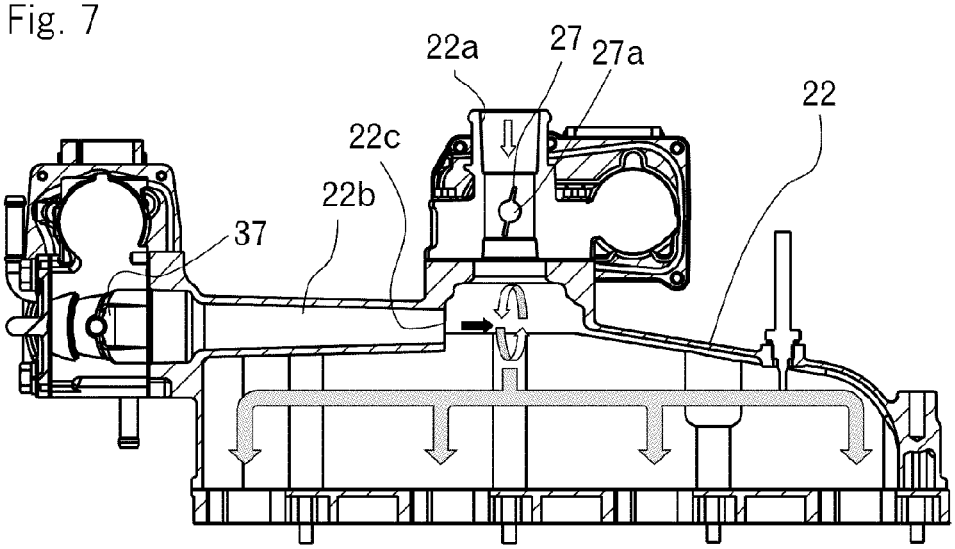
FIG. 7 is a sectional side view of the intake manifold.

As shown in FIG. 7, the introduction path 22*b* is provided inside the intake manifold 22. In this embodiment, a part of upper surface of the intake manifold 22 is shaped substantially semicircular while being projected upward so as to configure a wall surface of an upper part of the introduction path 22*b*, and a wall surface which is substantially semicircular and projected downward is configured inside the intake manifold 22 so as to configure a wall surface of a lower part of the introduction path 22*b*. The section of the introduction path 22*b* is configured circular, and a diameter of the section is reduced toward the downstream side. According to the configuration, the exhaust gas can be discharged from the exhaust port 22*c* without being dispersed.

The exhaust port 22*c* of the intake manifold 22 is arranged near the downstream side of the intake inlet 22*a* of the intake manifold 22. In detail, the exhaust port 22*c* is arranged downstream the intake inlet 22*a* provided in the upper part of the center of the intake manifold 22 and is substantially perpendicular to the intake inlet 22*a*.

According to the arrangement, as shown by a black arrow in FIG. 7, the flow of the exhaust gas discharged from the introduction path 22*b* is substantially perpendicular to the flow of the intake air supplied from the intake inlet 22*a*. Accordingly, the intake air and the exhaust gas can be mixed efficiently.

The valve shaft 27*a* arranged in the intake inlet 22*a* is perpendicular to the direction of the flow path of the intake inlet 22*a* and perpendicular to the flow of the exhaust gas of the introduction path 22*b*.

According to the configuration, as shown by a void arrow in FIG. 7, the flow of the intake air passing through the valve 27 is disturbed so that turbulence is generated, whereby the flow of the intake air become easy to be mixed with the exhaust gas flowing from the introduction path 22*b* and the mixing efficiency is improved further.

In this embodiment, the valve 27 is configured by the butterfly type throttle valve. However, the valve 27 is not limited thereto and may alternatively be configured by a slide valve in which a cylinder or a flat plate is slid perpendicularly to the flow path.

As the above, the engine 100 has the intake path 2 which guides the air sucked from the outside into the diesel engine 100. The intake path 2 has the intake manifold 22. The EGR device 35 supplying a part of the exhaust gas to the intake path 2 is provided. The introduction path 22*b* for introducing the exhaust gas supplied from the EGR device 35 is provided inside the intake manifold 22. The exhaust port 22*c* of the introduction path 22*b* is arranged near the downstream side of the intake inlet 22*a* of the intake manifold 22.

According to the configuration, the mixing efficiency of the exhaust gas (EGR gas) and the intake air can be improved without enlarging the whole engine, whereby exhaust gas performance can be improved.

The exhaust port 22*c* is provided so as to make the flow direction of the exhaust gas discharged from the exhaust port 22*c* perpendicular to the flow direction of the intake air.

According to the configuration, the exhaust gas (EGR gas) surely contacts the flow of the intake air, whereby the mixing efficiency of the EGR gas and the intake air can be improved further.

The valve 27 is provided in the intake inlet 22*a* of the intake manifold 22, and the valve shaft 27*a* of the valve 27 is arranged perpendicularly to the flow direction of the exhaust gas discharged from the exhaust port 22*c*.

According to the configuration, the exhaust gas (EGR gas) and the intake air are mixed for a short period by the turbulence generated by the passage of the gas through the valve 27, whereby the mixing efficiency can be improved further.

The intake manifold 22 has the plurality of the intake ports 12Ip. The intake ports 12Ip are arranged in a line, and the intake inlet 22*a* is arranged above the center of the line.

According to the configuration, the mixing rate of mixture intake gas supplied to each of the intake ports 12Ip is substantially uniform, whereby the exhaust gas performance of the whole diesel engine 100 can be improved.

INDUSTRIAL APPLICABILITY

The present invention can be used for an art of an engine.

DESCRIPTION OF NOTATIONS

100 diesel engine
1 engine main part
2 intake path
3 exhaust path
4 common rail system
22 intake manifold
22*a* intake inlet
22*b* introduction path
27 valve
27*a* valve shaft
35 EGR device
36 EGR cooler
37 EGR valve

What is claimed is:

1. An engine comprising:

an intake path configured to guide air sucked from outside the engine into the engine, the intake path comprising an intake manifold;

an EGR device supplying a part of exhaust gas to the intake path;

an introduction path disposed inside the intake manifold and configured to introduce the exhaust gas supplied from the EGR device to the intake path; and an exhaust port of the introduction path arranged near a downstream side of an intake inlet of the intake manifold, wherein the introduction path is circular and a diameter of the introduction path is reduced toward the downstream side.

2. The engine according to claim 1, wherein the exhaust port is provided so as to make a flow direction of the exhaust gas discharged from the exhaust port perpendicular to a flow direction of intake air.

3. The engine according to claim 2, wherein a valve is provided in the intake inlet of the intake manifold, and a valve shaft of the valve is arranged perpendicularly to the flow direction of the exhaust gas discharged from the exhaust port.

4. The engine according to claim 3, wherein the intake manifold has a plurality of intake ports, and wherein the intake ports are arranged in a line, and the intake inlet is arranged above a center of the line.

* * * * *